US010667573B2

(12) United States Patent
Kao et al.

(10) Patent No.: US 10,667,573 B2
(45) Date of Patent: Jun. 2, 2020

(54) VENTILATIVE SOLE STRUCTURE

(71) Applicant: DRKAO INTERNATIONAL CO., LTD., Taipei (TW)

(72) Inventors: Ming-Chun Kao, Taipei (TW); Sheng-Chiang Kao, Taipei (TW)

(73) Assignee: DRKAO INTERNATIONAL CO., LTD., Taipei (TW)

( * ) Notice: Subject to any disclaimer, the term of this patent is extended or adjusted under 35 U.S.C. 154(b) by 137 days.

(21) Appl. No.: 15/791,432

(22) Filed: Oct. 24, 2017

(65) Prior Publication Data

US 2019/0116920 A1 Apr. 25, 2019

(51) Int. Cl.
*A43B 7/08* (2006.01)
*A43B 13/20* (2006.01)

(52) U.S. Cl.
CPC ..... *A43B 7/088* (2013.01); *A43B 7/081* (2013.01); *A43B 7/082* (2013.01); *A43B 13/203* (2013.01)

(58) Field of Classification Search
CPC ..... A43B 7/081; A43B 7/082; A43B 7/088
See application file for complete search history.

(56) References Cited

U.S. PATENT DOCUMENTS 5,295,313 A * 3/1994 Lee ..... A43B 7/081 36/28
5,477,626 A * 12/1995 Kwon ..... A43B 13/203 36/3 B
5,975,861 A * 11/1999 Shin ..... A43B 7/081 36/29
6,305,099 B1 * 10/2001 Chu ..... A43B 7/08 36/29
7,082,696 B2 * 8/2006 Wu ..... A43B 7/081 36/3 B
2007/0294923 A1 * 12/2007 Hayakawa ..... A43B 7/081 36/3 B
2010/0223817 A1 * 9/2010 Chang ..... A43B 3/0073 36/3 B
2012/0102788 A1 * 5/2012 Park ..... A43B 7/06 36/25 R
2016/0331068 A1 * 11/2016 Bigolin ..... A43B 5/14

* cited by examiner

*Primary Examiner* — Jila M Mohandesi
(74) *Attorney, Agent, or Firm* — Leong C. Lei

(57) ABSTRACT

The ventilative sole structure includes a sole, a first one-way valve, and a second one-way valve. The sole's heel portion includes a hollow chamber inside and a bottom piece beneath the chamber. The first one-way valve is configured on a circumferential wall of the chamber. The second one-way valve is configured between a tread portion of the sole and the chamber. When a user wears a shoe with the ventilative sole structure, air enters the chamber through the first one-way valve when the user raises his/her feet, and air is released from the chamber through the second one-way valve towards the tread portion when the user treads on the ground and compresses the chamber, thereby enhancing ventilation and removing odor of the shoe.

1 Claim, 8 Drawing Sheets

VENTILATIVE SOLE STRUCTURE

BACKGROUND OF THE INVENTION

(a) Technical Field of the Invention

The present invention generally relates to shoes, and more particularly to a ventilative sole for shoes.

(b) Description of the Prior Art

A conventional shoe usually includes a sole, a pad, and an upper that closely wrap around the foot. Except some ventilation holes, the shoe is basically airtight. Therefore, after wearing a period of time, a strong and unpleasant smell would be developed. The closed shoe also causes skin diseases such as athlete's foot and has adversary effect to personal hygiene. Therefore there are shoes that provide improved ventilation by an air chamber, but their effect is avoiding odor is still less satisfactory. On the other hand, the addition of the air chamber structure causes the walking to be less steady.

SUMMARY OF THE INVENTION

Therefore, a major objective of the present invention is provide a ventilative sole structure where air flow is provided in a shoe's sole so as to avoid odor and a steadier walking may be achieved at the same time.

The ventilative sole structure includes a sole, a first one-way valve, and a second one-way valve. The sole's heel portion includes a hollow chamber inside and a bottom piece beneath the chamber. The first one-way valve is configured on a circumferential wall of the chamber. The second one-way valve is configured between a tread portion of the sole and the chamber. When a user wears a shoe with the ventilative sole structure, air enters the chamber through the first one-way valve when the user raises his/her feet, and air is released from the chamber through the second one-way valve towards the tread portion when the user treads on the ground and compresses the chamber, thereby enhancing ventilation and removing odor of the shoe.

The sole's heel portion further includes a bottom piece on a bottom side of the heel portion. The bottom piece has a front vertical side, a back vertical side, and a lateral bottom side whose two ends connecting the front and back vertical sides, respectively. The front vertical side's height is smaller than the back vertical side's height. The corners connecting the front and back vertical sides to the lateral bottom side are rounded, respectively. The rounded corners allow a greater contact area with the ground, thereby achieving a greater compression effect to the chamber and waling with the ventilative sole structure steadier. When a user wears a shoe with the ventilative sole structure, air enters the chamber through the first one-way valve when the user raises his/her feet, and air is released from the chamber through the second one-way valve towards the tread portion when the user treads on the ground and compresses the chamber, thereby enhancing ventilation and removing odor of the shoe.

Each of the first and second one-way valve comprises a base element, a positioning element, a blocking sheet, and a filter element. The base element has a sleeve section and a back section of a smaller diameter. The sleeve section's inner back wall has a plurality of protrusion. The tubular positioning element is plugged into the sleeve section. The positioning element has a back section for plugging into the sleeve section. Within the back section, there is a platform.

The blocking sheet is placed between the platform and the protrusions. The tubular filter element is plugged into a front section of the positioning element. When air is drawn into the positioning element, the blocking sheet is supported by the protrusions, and air would flow out of the back section of the base element through a gap between the protrusions and the blocking sheet. The blocking sheet seals the platform to prevent air from flowing back out through the positioning element.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
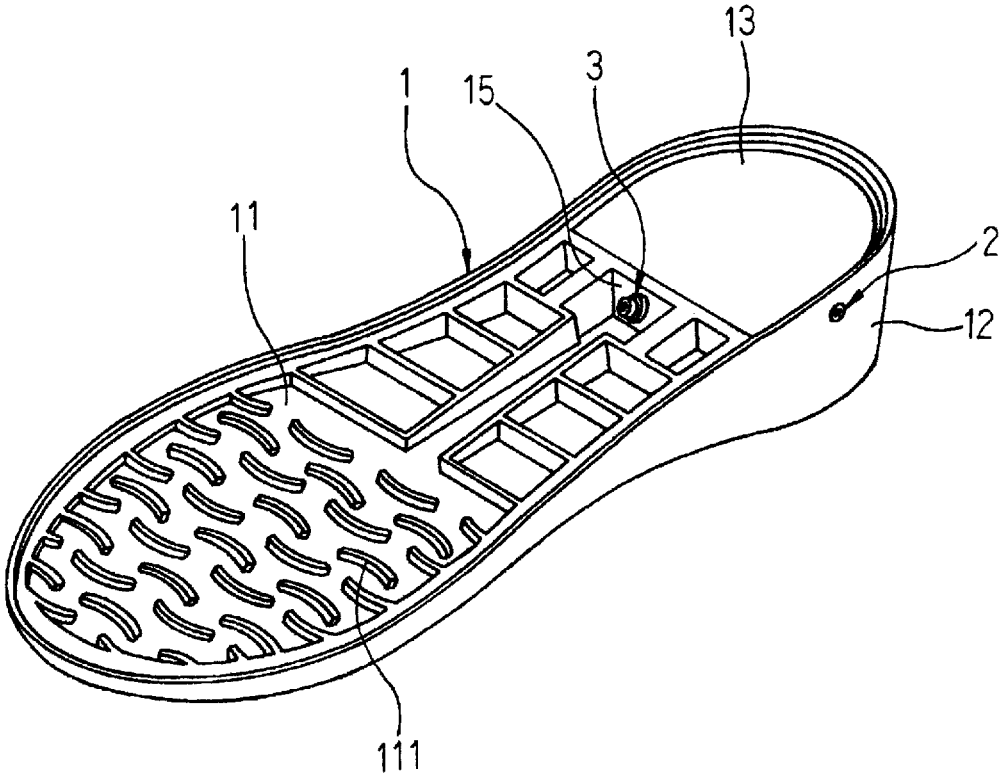
FIG. 1 is a perspective diagram showing a ventilative sole structure according to an embodiment of the present invention.
Figure 2:
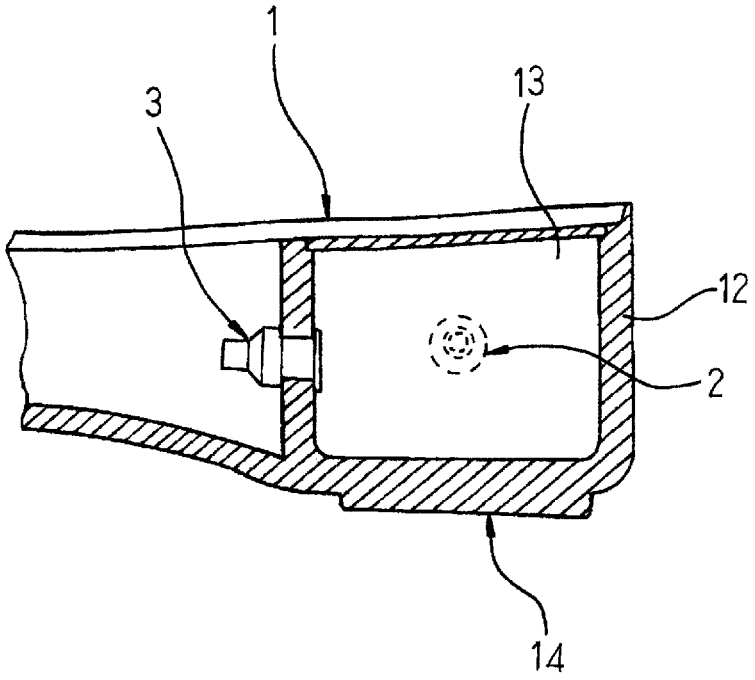
FIG. 2 is a schematic sectional diagram showing a chamber of the ventilative sole structure of FIG. 1.
Figure 3:
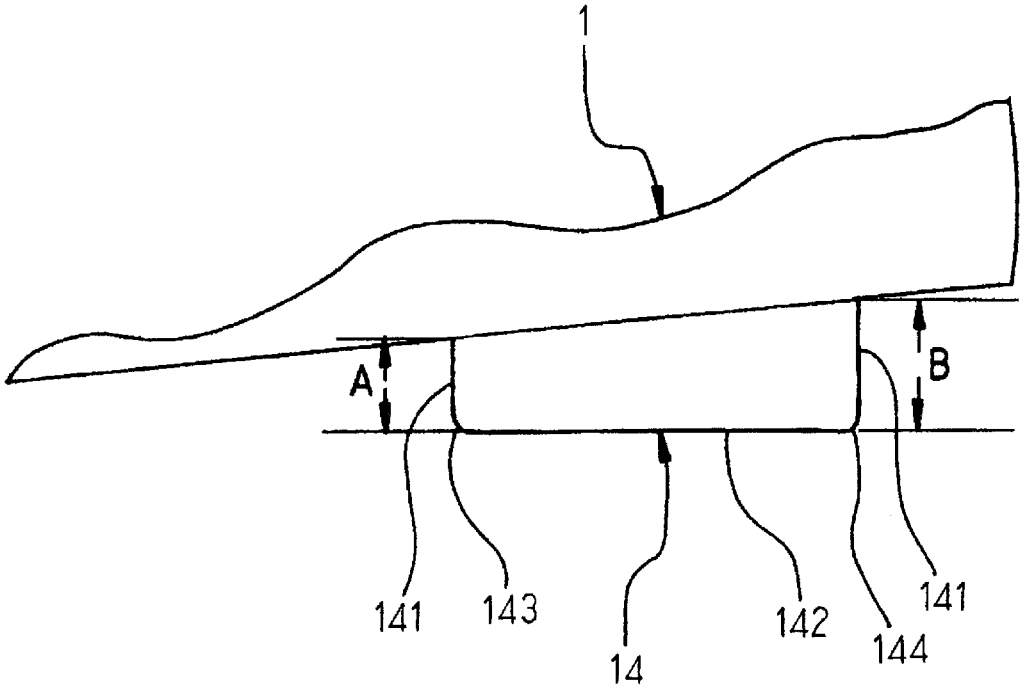
FIG. 3 is a schematic profile diagram showing a heel portion of the ventilative sole structure of FIG. 1.

As shown in FIGS. 1 to 3, a ventilative sole structure according to an embodiment of the present invention includes a sole 1, a first one-way valve 2, and a second one-way valve 3. The sole 1 includes a tread portion 11 and a heel portion 12. The tread portion 11 includes a number of ribs 111 arranged at intervals. The heel portion 12 includes a hollow chamber 13 and a bottom piece 14 on a bottom side of the heel portion 12. In the present embodiment, the thickness of the bottom piece 14 is lower along a front portion and higher along a back portion of the bottom piece 14.

The first one-way valve 2 is configured on a circumferential wall of the chamber 13. The second one-way valve 3 is configured between the tread portion 11 and the heel portion 12. A partition wall 15 is provided between the chamber 13 and the tread portion 11, and the second one-way valve 3 is configured on the partition wall 15.

The bottom piece 14 has front and back vertical sides 141 and a lateral bottom side 142 connecting the vertical sides 141 at corners 143 and 144, respectively. The corners 143 and 144 are rounded with an appropriate curvature. Therefore, together with the bottom piece 14's lower-front-and-higher-back design, the ventilative sole structure provides a more reliable tread. The rounded corners 143 and 144 allow a greater contact area with the ground and thereby a greater compression to the chamber 13. The front vertical side 141's height A is smaller than the back vertical side 141's height B, and preferably their ratio is 3:5 or 4:6. For example, if the height A is 18 mm, the height B is 30 mm or, if the height A is 16 mm, the height B is 24 mm.

As described above, when a user wears a shoe with the ventilative sole structure, air enters the chamber 13 through the first one-way valve 2 when the user raises his/her feet, and air is released from the chamber 13 through the second one-way valve 3 towards the tread portion 11 when the user treads on the ground and compresses the chamber 13. The process of drawing air into chamber 13 via the first one-way vale 2 and expelling air towards the tread portion 11 via the second one-way valve 3 repeats itself as the user walks. The ventilative sole structure therefore functions as if it is breathable. The shoe is as such more comfortable to walk, and the odor of the shoe may be removed as well. The bottom piece 14's lower-front-and-higher-back design provides a more reliable tread. The rounded corners 143 and 144 allow a greater contact area with the ground and thereby a greater compression to the chamber 13.

Figure 4:
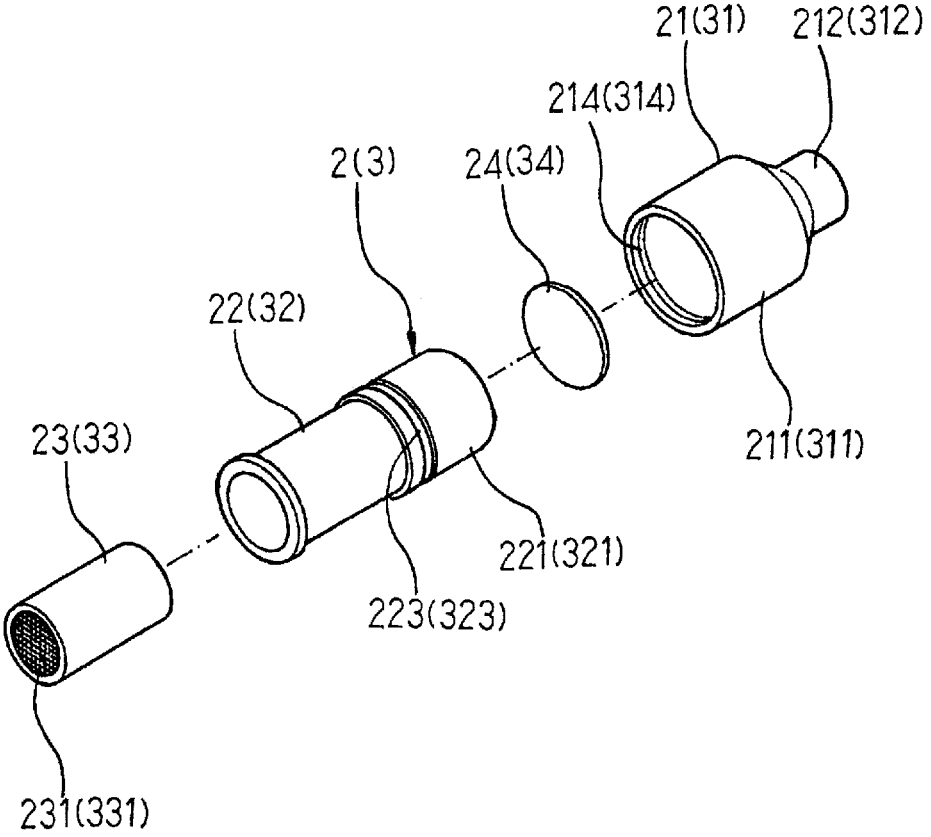
FIG. 4 is a perspective breakdown diagram showing a one-way valve of the ventilative sole structure of FIG. 1.
Figure 5:
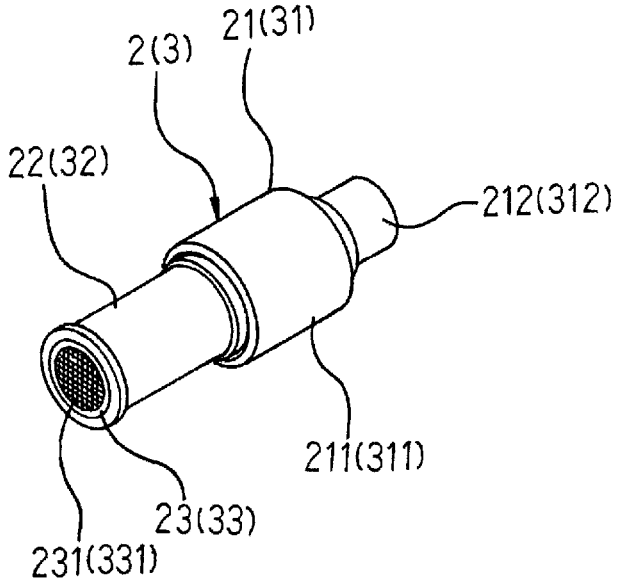
FIG. 5 is a perspective breakdown diagram showing the one-way valve of FIG. 4 after its assembly.
Figure 6:
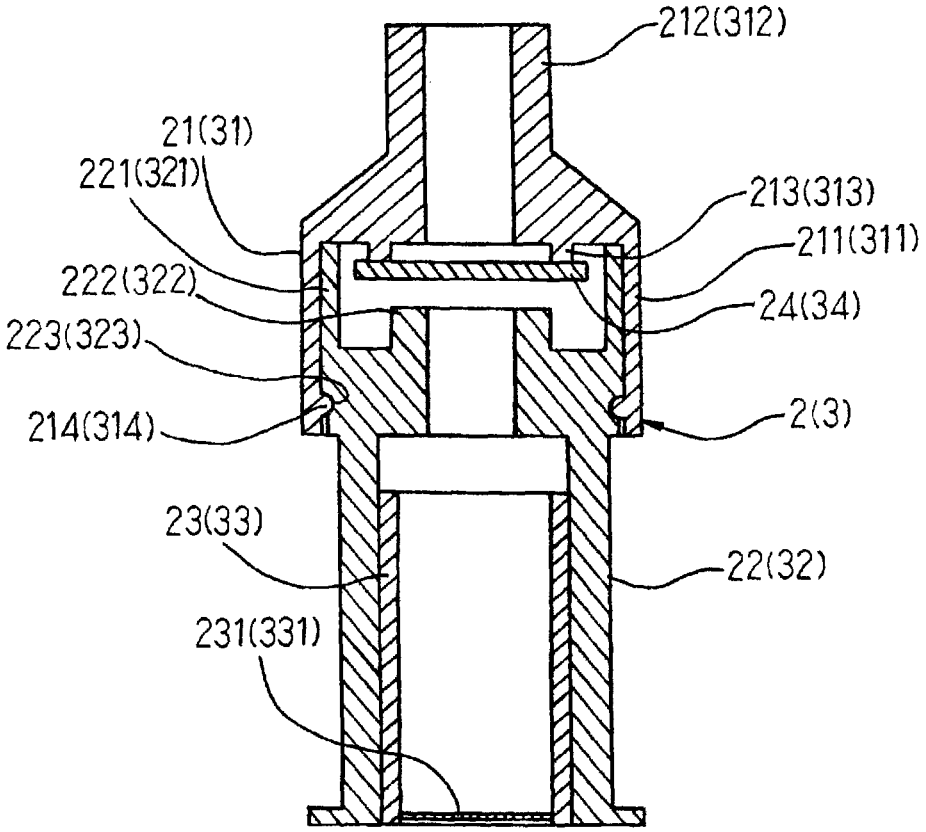
FIG. 6 is a sectional diagram showing the one-way valve of FIG. 5.

As shown in FIGS. 4 to 6, the first and second one-way valves 2 and 3 includes base elements 21 and 31, positioning elements 22 and 32, and filter elements 23 and 33. The base elements 21 and 31 have sleeve sections 211 and 311 and back sections 212 and 312 of a smaller diameter. The sleeve sections 211 and 311's inner circumferential walls have ring ribs 214 and 314. The sleeve sections 211 and 311's inner back walls have protrusions 213 and 313. The tubular positioning elements 22 and 32 have back sections 221 and 321 for plugging into the sleeve sections 211 and 311. Within the back sections 221 and 321, there are platforms 222 and 322. Outside the back sections 221 and 321, there are ring grooves 223 and 323 for receiving the ring ribs 214 and 314. Blocking sheets 24 and 34 are first placed between the platforms 222 and 322, and protrusions 213 and 313, and the positioning elements 22 and 32 are plugged into the sleeve sections 211 and 311 and reliably fastened together by the ring ribs 214 and 314's embedment into the ring grooves 223 and 323. In the present embodiment, the blocking sheets 24 and 34 are made of a flexible plastic material. When air is drawn into the positioning elements 22 and 32, the blocking sheets 24 and 34 are supported by the protrusions 213 and 313, and air would flow out of the back sections 212 and 312 of the base elements 21 and 31. On the other hand, the blocking sheets 24 and 34 would seal the platforms 222 and 322 to prevent air from flowing back out through the positioning elements 22 and 32.

The tubular filter elements 23 and 33 are plugged into front sections of the positioning elements 22 and 32. Filters 231 and 331 are positioned at the filter elements 23 and 33's front ends.

Figure 7:
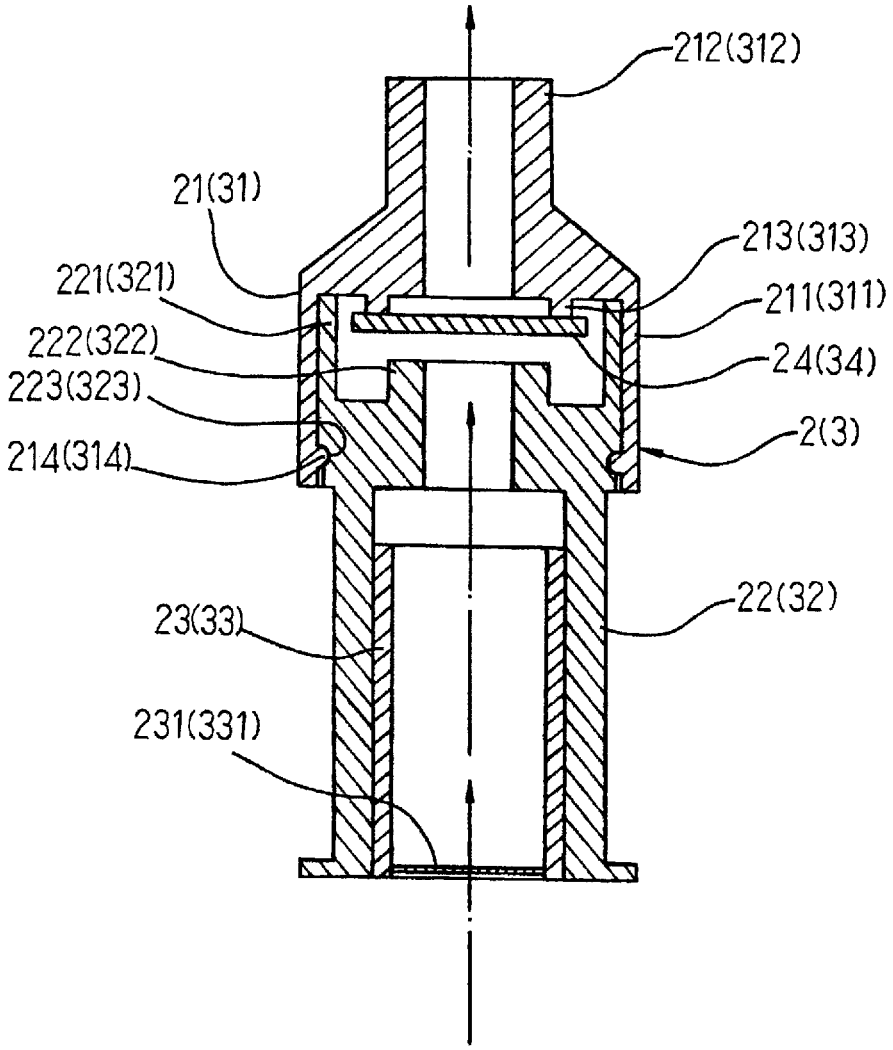
FIG. 7 is a sectional diagram showing a scenario of the one-way valve of FIG. 5 where air flow is allowed in one direction.

As shown in FIG. 7, together with FIGS. 1 and 2, when a shoe with the ventilative sole structure is raised after treading, outside air flows through the positioning element 22 and the filter element 23, and the blocking sheet 24 is pushed against the protrusions 213. As there is a gap between the protrusions 213 and the blocking sheet 24, the outside air flows into the chamber 13 through the back section 212 of the base element 21. Following the same process, when a shoe with the ventilative sole structure treads on the ground, the air stored in the chamber 13 is compressed and flows through the filter element 33, the positioning element 32, the gap between the protrusions 313 and the blocking sheet 34, and the back section 312 of the base element 31 of the second one-way valve 3 towards the tread portion 11 for enhanced ventilation. As such, the shoe is more comfortable to wear and odor is avoided. The filters 23 and 33 filters the debris and dusts so that the air flowing into and out of the chamber 13 is cleaned.

Figure 8:
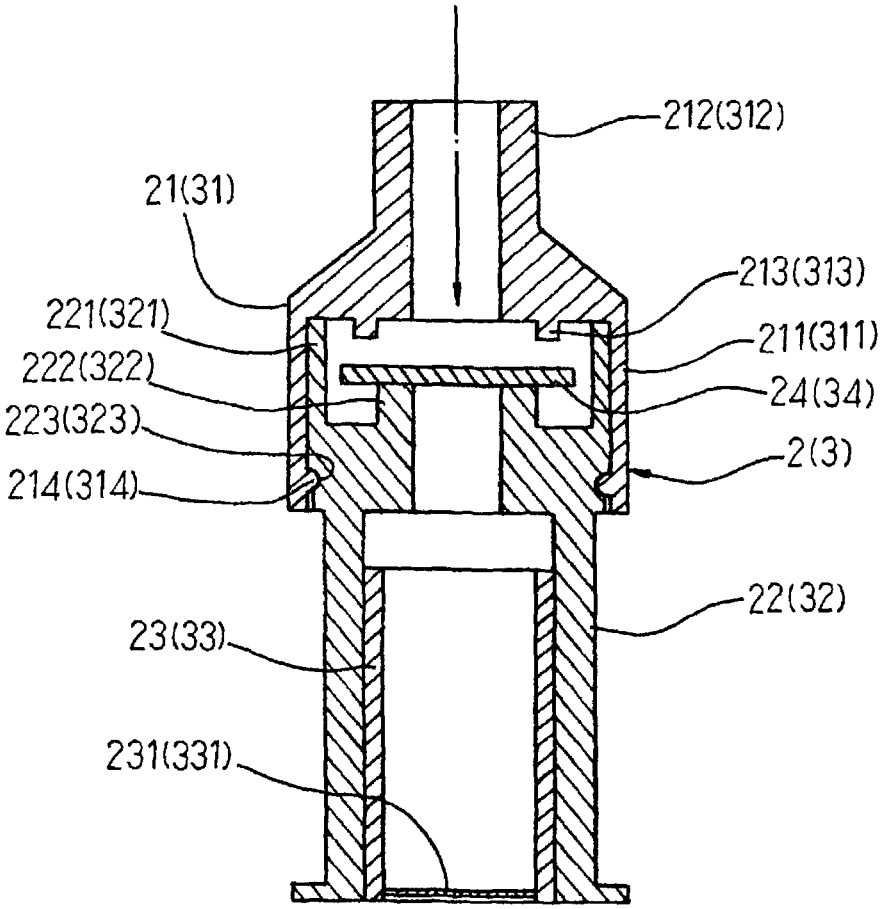
FIG. 8 is a sectional diagram showing another scenario of the one-way valve of FIG. 5 where air flow is blocked in an opposite direction.

As shown in FIG. 8, together with FIGS. 1 and 2, when a shoe with the ventilative sole structure is raised after treading and as the chamber 13 expands and air tries to flow through the second one-way valve 3, the air pushes the blocking sheet 34 against and seals the platform 322. As such, the air in chamber 13 does not flow out of the chamber 13 through the second one-way valve 3. Following the same process, when a shoe with the ventilative sole structure treads on the ground, the air in the chamber 13 does not flow through the first one-way valve 2 as the blocking sheet 24 blocks the platform 222.

As shown in FIG. 2, the bottom piece 14 under the heel portion 12 has an appropriate height, and with its lower-front-and-higher-back design, the ventilative sole structure provides a more reliable tread. The corners 143 and 144 between the vertical sides and the lateral side are rounded so as to allow a greater contact area with the ground and thereby a better compression effect to the chamber 13. The user may also walk in a more reliable and straighter manner.

As described above, the gist of the ventilative sole structure lies in the chamber at the heel portion and the one-way valves on the chamber's wall so that ventilative air flow is achieved as a user walks and odor is removed as well.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A ventilative sole structure, comprising a sole, a first one-way valve, and a second one-way valve, wherein the sole comprises a tread portion and a heel portion; the tread portion has a plurality of ribs arranged at intervals; the heel portion comprises a hollow chamber inside and a bottom piece on a bottom side of the heel portion beneath the chamber, where the bottom piece has a front vertical side, a back vertical side, and a lateral bottom side whose two ends connecting the front and back vertical sides, respectively, the front vertical side's height is smaller than the back vertical side's height, the ratio between the front vertical side's height and the back vertical side's height is 3:5 or 4:6, and the corners connecting the front and back vertical sides to the lateral bottom side are rounded, respectively;

the first one-way valve is configured on a circumferential wall of the chamber;

a partition wall is provided between the chamber and the tread portion;

the second one-way valve is configured on the partition wall;

the second one-way valve is configured between the tread portion and the chamber of the heel portion;

each of the first and second one-way valve comprises a base element, a positioning element, a blocking sheet, and a filter element; the base element has a sleeve section and a back section of a smaller diameter; the sleeve section's inner back wall has a plurality of protrusion; the tubular positioning element is plugged into the sleeve section; the positioning element has a back section for plugging into the sleeve section; within the back section, there is a platform; the blocking sheet is placed between the platform and the protrusions; a tubular filter element is plugged into a front section of the positioning element; when air is drawn into the positioning element, the blocking sheet is supported by the protrusions, and air would flow out of the back section of the base element through a gap between the protrusions and the blocking sheet; and the blocking sheet seals the platform to prevent air from flowing back out through the positioning element;

the sleeve section's inner circumferential wall has a ring rib; outside the back section, there is a ring groove for receiving the ring rib; and the positioning element and the base element are reliably fastened together by the ring rib's embedment into the ring groove;

the blocking sheets are made of a flexible plastic material;

when a user wears a shoe with the ventilative sole structure, air enters the chamber through the first one-way valve when the user raises his/her feet, and air is released from the chamber through the second one-way valve towards the tread portion when the user treads on the ground and compresses the chamber; and the process of drawing air into chamber via the first one-way vale and expelling air towards the tread portion via the second one-way valve repeats itself as the user walks.

* * * * *